US012577767B2

(12) United States Patent
Kuo et al.

(10) Patent No.: US 12,577,767 B2
(45) Date of Patent: Mar. 17, 2026

(54) REPLACEABLE STRUCTURE FOR A BATHTUB OVERFLOW PIPE

(71) Applicants: BRIDGING PARTNERS CORPORATION, Taipei City (TW); Chih-Wei Chen, Changhua County (TW)

(72) Inventors: Kuang-Ming Kuo, New Taipei City (TW); Chih-Wei Chen, Changhua County (TW)

(73) Assignees: Chih-Wei Chen, Changhua County (TW); Bridging Partners Corporation, Taipei City (TW); Unik Industry Limited, Apia (WS)

( * ) Notice: Subject to any disclaimer, the term of this patent is extended or adjusted under 35 U.S.C. 154(b) by 0 days.

(21) Appl. No.: 18/366,146

(22) Filed: Aug. 7, 2023

(65) Prior Publication Data

US 2025/0052044 A1 Feb. 13, 2025

(51) Int. Cl.
*E03C 1/244* (2006.01)

(52) U.S. Cl.
CPC ..... *E03C 1/244* (2013.01)

(58) Field of Classification Search
CPC ... E03C 1/22; E03C 1/232; E03C 1/24; E03C 1/244
See application file for complete search history.

(56) References Cited

U.S. PATENT DOCUMENTS

| | | | | |
|---|---|---|---|---|
| 2,477,478 | A * | 7/1949 | Donahue | E03C 1/22 285/191 |
| 9,982,424 | B1 * | 5/2018 | Kuo | E03C 1/24 |
| 10,017,925 | B1 * | 7/2018 | Kuo | E03C 1/24 |
| 11,466,439 | B1 * | 10/2022 | Kuo | E03C 1/244 |
| 12,012,735 | B2 * | 6/2024 | Ahuja | E03C 1/24 |
| 2009/0249542 | A1 * | 10/2009 | Uhl | E03C 1/24 4/694 |
| 2017/0335554 | A1 * | 11/2017 | Kuo | E03C 1/24 |

* cited by examiner

*Primary Examiner* — Erin Deery
(74) *Attorney, Agent, or Firm* — Rosenberg, Klein & Lee

(57) ABSTRACT

A bathtub overflow pipe includes an overflow pipe, an adapter and a over. The overflow pipe includes an extending section with an outlet. The adapter is connected to the end face of the extending section of the overflow pipe by bolts. The adapter includes a sleeve and a tab extending radially from one end of the sleeve. The sleeve includes a passage and is inserted into the outlet of the overflow pipe. The tab has a recess formed to its lower edge and communicating with the outlet for drainage. The cover includes a pillar and a rim which has a recessed area. The pillar extends axially from one of two sides of the cover and has a rib. The pillar extends through the passage of the adapter, the rib is slidably engaged with the recessed rail. The cover, the adapter and the overflow pipe can be precisely and easily assembled.

3 Claims, 5 Drawing Sheets

REPLACEABLE STRUCTURE FOR A BATHTUB OVERFLOW PIPE

FIELD OF THE INVENTION

The present invention relates to a replaceable structure for a bathtub overflow pipe, and more particularly, to the overflow pipe designed for draining excessive water, and a cover placed on the surface of the bathtub.

BACKGROUND OF THE INVENTION

An overflow outlet is typically installed at a maximum water level in bathtubs. When the water in the bathtub reaches the maximum water level, the excess water flows from the outlet to the overflow pipe, and directly drains to the drainage pipe of the bathtub. This allows for direct drainage and prevents the bathtub from overflowing and even flooding the bathroom floor and causing slip hazards.

There are various forms of combination structures for such overflow pipes and covers. For instance, Taiwanese Patent No. M613952 titled "Replaceable Assembly Structure for Bathtub Overflow Outlet" features an adapter component with a circular body. The inner diameter of this body is suitable for fitting onto the overflow pipe. Two transverse connecting pieces extend from the inner periphery of the body and passing through the centerline. A central hole is established at the midpoint of these connecting pieces, with two side holes on either end which are aligned with the central hole. The outer circumferential surface of the body is divided into equal segments, with claw-like protrusions extending vertically. These claw-like protrusions align with a circular track, and a groove is concavely carved along the radial direction of the body. A compression ring fits onto the grooves of the claw-like protrusions, facilitating the inner side of the cover to be compressed against the outer side of the compression ring. This design allows for the locking hole on the end face of the overflow pipe to be linked with the cover, whether it is a single-hole, double-hole, or no-hole type cover, through the component of the adapter.

The structure of the invention facilitates the design of the overflow pipe's end face as a single-hole or double-hole configuration, ensuring that both single-hole and double-hole covers can be applied when replacing covers in the future. However, there are several concerns that affect its market competitiveness: High cost: The complexity of the columnar shape with a locking hole on the end of the overflow pipe and the relatively intricate structure of the adapter, which includes the transverse connecting pieces extending from the circular body, a central hole, and side holes on both ends of the connecting pieces, as well as the claw-like protrusions on the outer circumferential surface of the body with grooves for the compression ring, results in a more complicated component design.

The adapter is made of metal materials. In today's context of high raw material costs, this cost factor does not align with market competitiveness.

The present invention intends to provide a replaceable structure for a bathtub overflow pipe so as to overcome the shortcomings mentioned above.

SUMMARY OF THE INVENTION

The present invention relates to a replaceable structure for a bathtub overflow pipe, and comprises an elongate overflow pipe which includes an inverted L-shaped end vertically extending from the distal end of the overflow pipe. The inverted L-shaped end includes a horizontally extending section, and an outlet is defined in the extending section for discharging water. An adapter is connected to the overflow pipe and includes a sleeve and a tab which extends radially from one end of the sleeve. The sleeve includes a passage defined therethrough. The tab is semicircular in shape, and a recess is formed to the lower edge of the tab and communicates with the outlet of the overflow pipe. A recessed rail IS defined axially the inner periphery of the passage of the sleeve. The sleeve is inserted into the outlet and the tab is secured to the extending section of the overflow pipe. The tab is placed against a bathtub. A cover has a rim extending toward a first side of the cover. The rim of the cover has a recessed area which communicates with the recess of the adapter. A pillar extends axially from one of two sides of the cover. A rib extends axially from the outer periphery of the pillar. The pillar extends through the passage of the adapter, and the rib is slidably engaged with the recessed rail. The primary object of the present invention is to provide an overflow pipe and comprises an adapter which is connected to the overflow pipe. The cover is secured to the overflow pipe. The cover is assembled to the adapter by a cooperation of a recessed aril and a rib so as to quickly and easily combine the cover, the adapter and the overflow pipe. The adapter includes a semicircular tab so as to drain the water efficiently.

The present invention provides the following advantages wherein the adapter that is locked in place at the extending section of the overflow pipe, and the adapter includes a recessed rail on the inner periphery of the passage. The cover includes a rib corresponding to the outer side of the pillar which is inserted into the passage. During the assembly process of the cover onto the adapter, the immediate engagement between the recessed rail and the rib facilitates rapid and accurate assembly of the cover onto the adapter. The positioning of the rib and recessed rail ensures that the recess of the adapter for overflow water is located at the lower portion of the adapter, and the recessed area of the cover is also located at the lower portion of the adapter so as to provide a secure and swift combination of the cover with the adapter. The design of this snug fit prevents the cover from easily detaching from the adapter and the overflow pipe, ensuring stability and effectiveness.

The lower portion of the adapter forms a discharge passage, and communicates with the recessed area of the cover and the outlet of the overflow pipe. This design facilitates the smooth drainage of water overflowing from the bathtub.

The simple and uncomplicated shapes of the cover and the adapter do not require metallic materials for manufacturing, effectively reducing production costs.

The pillar of the cover has a sealing ring mounted thereto, ensuring that it remains attached to the adapter during assembly. Additionally, the cover does not have screw holes, enhancing its aesthetic appeal. This design makes it convenient for future replacement of the cover.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
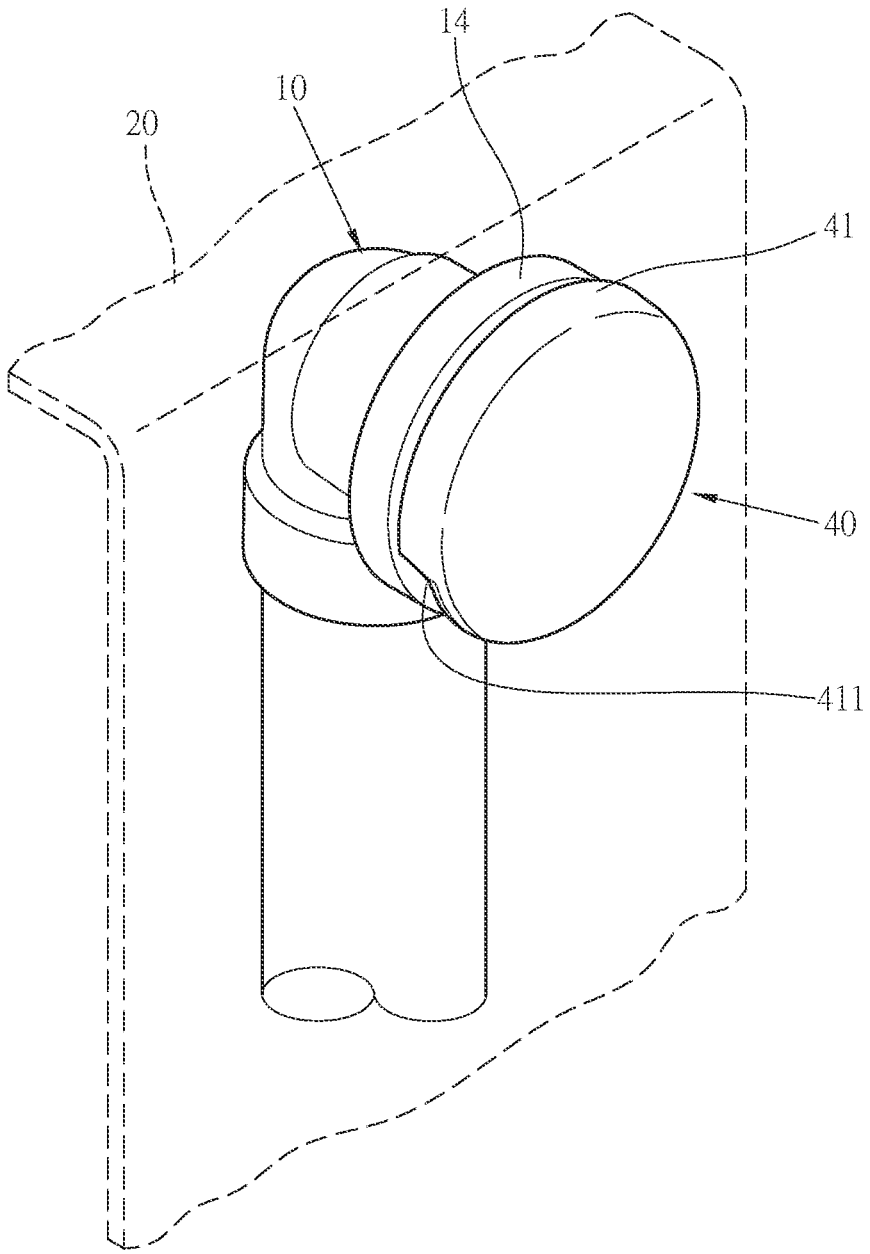
FIG. 1 is a perspective view to show that the overflow pipe of the present invention is installed to a bathtub.
Figure 2:
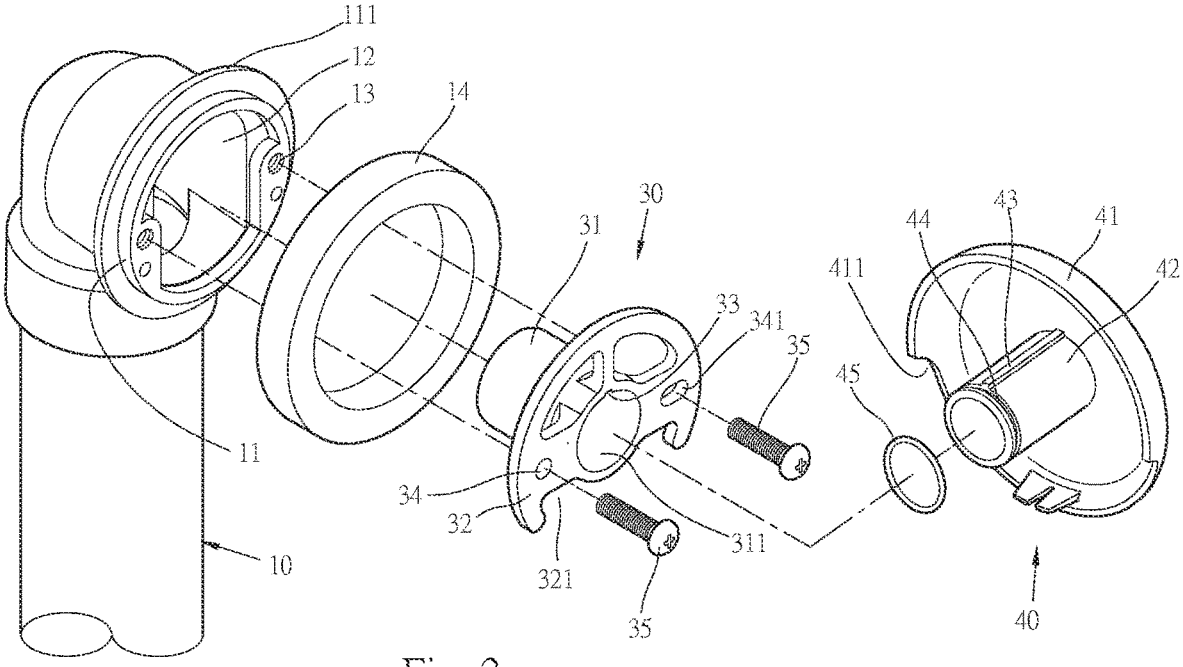
FIG. 2 is an exploded view to show the overflow pipe, the adapter and the cover of the present invention.
Figure 3:
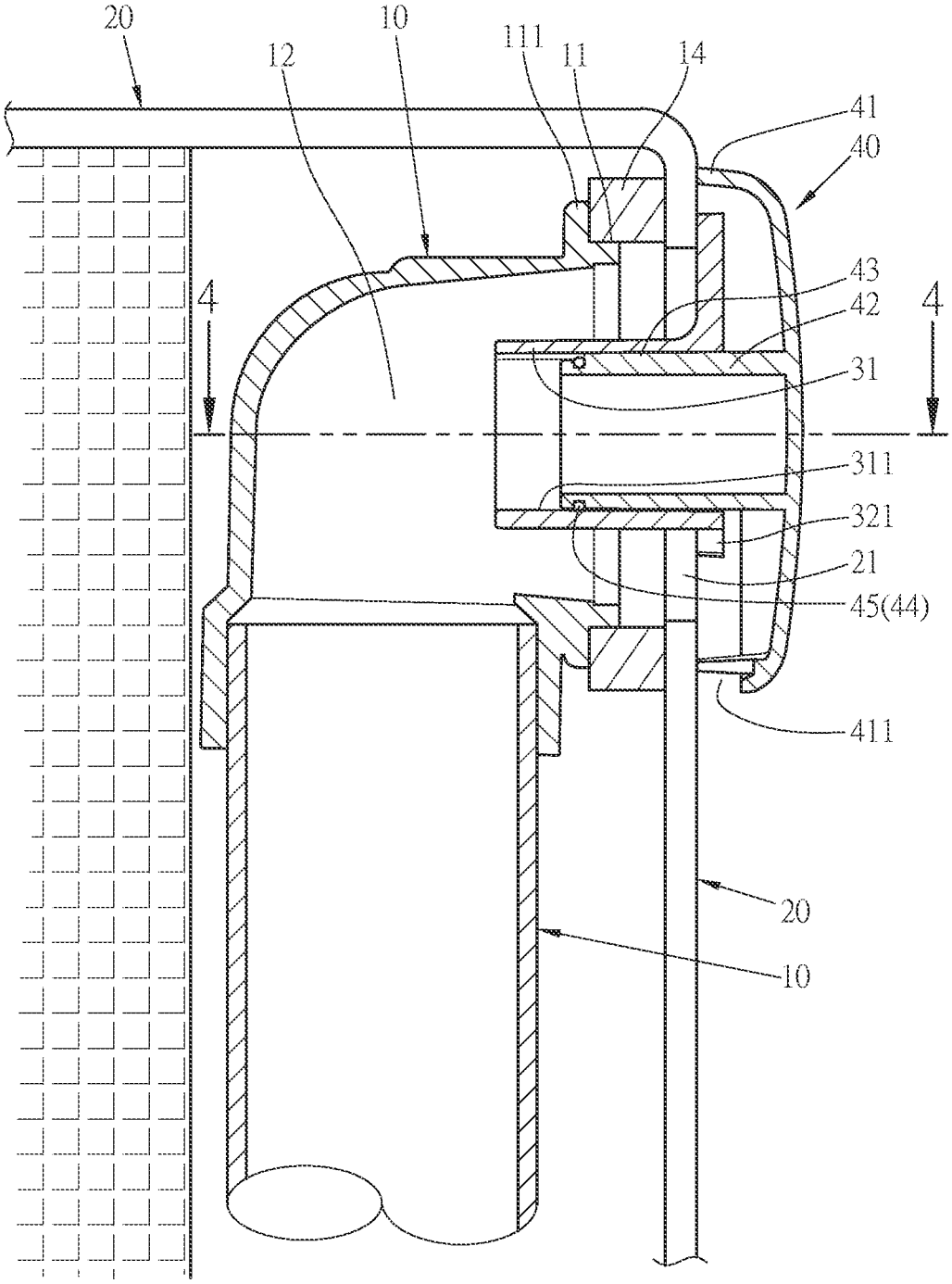
FIG. 3 is a side cross sectional view perspective view to show the overflow pipe of the present invention installed to a bathtub.

Referring to FIGS. 1 to 3, the replaceable structure for a bathtub overflow pipe of the present invention comprises an overflow pipe 10 which is an elongated tube and includes an inverted L-shaped end vertically extending from the distal end of the overflow pipe 10. The inverted L-shaped end includes a horizontally extending section 11, and an outlet 12 is defined in the extending section 11 for discharging water. At least two threaded holes 13 are defined in the end face of the extending section 11 of the overflow pipe 10. The outlet 12 is located between the at least two threaded holes 13. A flange 111 extends radially from the outer periphery of the extending section 11 of the overflow pipe 10 and is located at a distance from the end face of the extending section 11. A collar 14 is mounted to the outer periphery of the extending section 11 and contacts against the flange 111. As shown in FIG. 3, the extending section 11 of the overflow pipe 10 extends through the bore 21 of the bathtub 20. The collar 14 is claimed between the flange 111 and the wall of the bathtub 20. The outlet 12 of the extending section 11 is located close to the bathtub 20.

Figure 4:
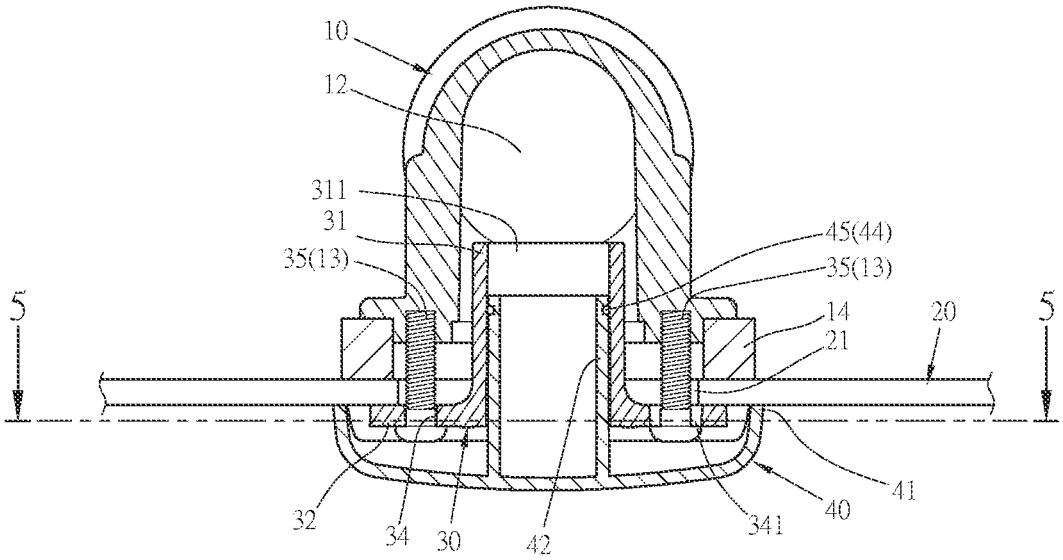
FIG. 4 is a top cross sectional view of the overflow pipe of the present invention installed to a bathtub.
Figure 5:
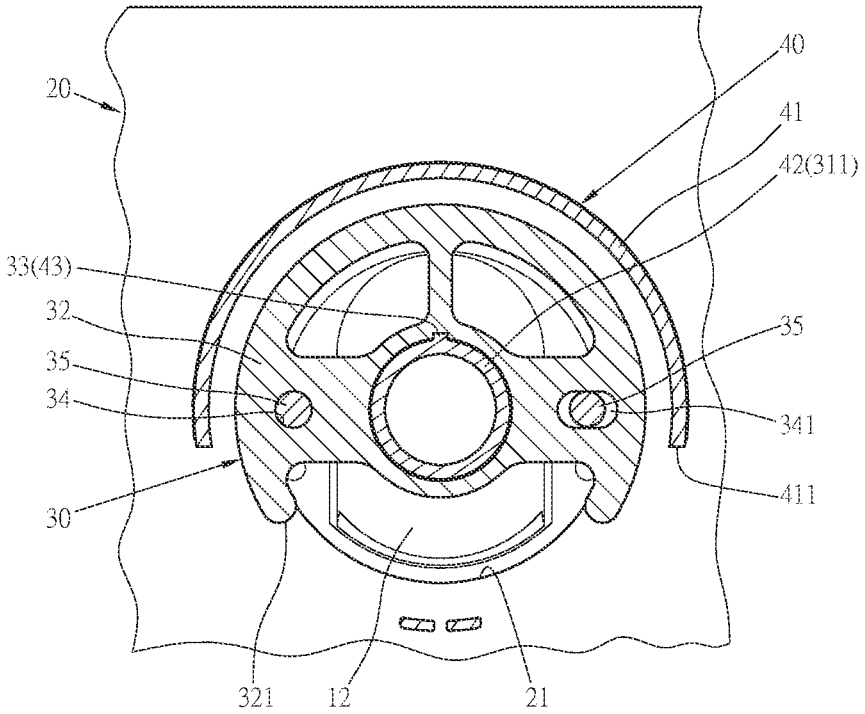
FIG. 5 is an end cross sectional view of the overflow pipe of the present invention installed to a bathtub.

As shown in FIGS. 2 to 4, an adapter 30 includes a sleeve 31 and a tab 32 which extends radially from one end of the sleeve 31. The sleeve 31 includes a passage 311 defined therethrough. The tab 32 is semicircular in shape, and a recess 321 is formed to the lower edge of the tab 32 and communicates with the outlet 12 of the overflow pipe 10. A recessed rail 33 is defined axially in the inner periphery of the passage 311 of the sleeve 31. The sleeve 31 is inserted into the outlet 12, and the tab 32 is secured to the extending section 11 of the overflow pipe 10. A first hole 34 and a second hole 341 are respectively defined through the tab 32, wherein the second hole 341 is an elongate hole. Two bolts 35 extend through the first and second holes 341, the bore 21 of the bathtub 20, and are connected to the at least two threaded holes 13 of the extending section 11 to connect the adapter to the end face of the extending section 11. The tab 32 is placed against the bathtub 20.

As shown in FIGS. 2 to 4, a cover 40 includes a rim 41 extending toward a first side of the cover 40. The rim 41 of the cover 40 has a recessed area 411 which communicates with the recess 321 of the adapter 30. A pillar 42 extending axially from the first side of the cover 40, and a rib 43 extends axially from the outer periphery of the pillar 42. The pillar 42 extends through the passage 311 of the adapter 30. The rib 43 is slidably engaged with the recessed rail 33. The pillar 42 of the cover 40 includes an annular groove 45, and a sealing ring 45 is engaged with the annular groove 45.

As shown in FIGS. 2 to 5, when installing the overflow pipe 10 to the bathtub 20, the recessed area 33 of the adapter 30 faces upward to align the first and second holes 34, 341 with the at least two threaded holes 13. The two bolts 35 extend through the first and second holes 34, 341 and are connected to the at least two threaded holes 13. The second hole 341 is an elongate hole so as to compensate the machining tolerance of the at least two threaded holes 13 to ensure that the bolts 35 are connected to the at least two threaded holes 13. The rib 43 is slidably engaged with the recessed rail 33 to ensure that when the cover 40 is assembled to the adapter 30, the recessed area 411 is located at the lower portion of the whole overflow pipe assembly. The recess 321 of the adapter 30 together with the recessed area 411 of the cover 40 allow the water to be drained smoothly. As shown in FIG. 3, the sealing ring 45 is engaged with the annular groove 45 of the pillar 42 ensures that the pillar 42 is snugly engaged with the passage 311 of the adapter, and the cover 40 is not disengaged from the adapter 30 easily.

While we have shown and described the embodiment in accordance with the present invention, it should be clear to those skilled in the art that further embodiments may be made without departing from the scope of the present invention.

What is claimed is:

1. A replaceable structure for a bathtub overflow pipe, comprising:

an overflow pipe being an elongated tube and including an inverted L-shaped end vertically extending from a distal end of the overflow pipe, the inverted L-shaped end including a horizontally extending section, an outlet defined in the extending section for discharging water;

an adapter connected to the overflow pipe and including a sleeve and a tab extending radially from one end of the sleeve, the sleeve including a passage defined therethrough, the tab being semicircular in shape, a recess formed to a lower edge of the tab and communicating with the outlet of the overflow pipe, a recessed rail defined on and extending axially along an inner periphery of the passage of the sleeve, the sleeve inserted into the outlet and the tab being secured to the extending section of the overflow pipe, the tab adapted to be placed against a bathtub, and a cover having a rim extending toward a first side of the cover, the rim of the cover having a recessed area which communicates with the recess of the adapter, a pillar extending axially from one of two sides of the cover, a rib defined on an extending axially along an outer periphery of the pillar, the pillar extending through the passage of the adapter, the rib slidably engaged with the recessed rail.

2. The replaceable structure for a bathtub overflow pipe as claimed in claim 1, wherein a flange extends radially from an outer periphery of the extending section of the overflow pipe and is located at a distance from an end face of the extending section, a collar is mounted to the outer periphery of the extending section and contacts against the flange, at least two threaded holes are defined in the end face of the extending section of the overflow pipe, the outlet is located between the at least two threaded holes, a first hole and a second hole are respectively defined through the tab, two bolts extend through the first and second holes and are connected to the at least two threaded holes of the extending section, the second hole is an elongate hole.

3. The replaceable structure for a bathtub overflow pipe as claimed in claim 1, wherein the pillar of the cover includes an annular groove, a sealing ring is engaged with the annular groove.

* * * * *